US007832477B2

(12) United States Patent
Cavender et al.

(10) Patent No.: US 7,832,477 B2
(45) Date of Patent: Nov. 16, 2010

(54) CASING DEFORMATION AND CONTROL FOR INCLUSION PROPAGATION

(75) Inventors: Travis W. Cavender, Angleton, TX (US); Roger L. Schultz, Ninnekah, OK (US); Grant Hocking, London (GB); Robert Pipkin, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 138 days.

(21) Appl. No.: 11/966,212

(22) Filed: Dec. 28, 2007

(65) Prior Publication Data

US 2009/0166040 A1 Jul. 2, 2009

(51) Int. Cl.
*E21B 29/08* (2006.01)
*E21B 43/04* (2006.01)
*E21B 43/26* (2006.01)

(52) U.S. Cl. ..... 166/278; 166/206; 166/207; 166/297; 166/308.1; 166/381

(58) Field of Classification Search ..... None
See application file for complete search history.

(56) References Cited

U.S. PATENT DOCUMENTS 2,642,142 A 6/1953 Clark
2,687,179 A 8/1954 Dismukes
2,862,564 A 12/1958 Bostock
2,870,843 A 1/1959 Rodgers, Jr.
3,058,730 A 10/1962 Bays
3,062,286 A 11/1962 Wyllie
3,071,481 A 1/1963 Beach et al.
3,270,816 A 9/1966 Staadt
3,280,913 A 10/1966 Smith
3,338,317 A 8/1967 Shore
3,351,134 A 11/1967 Kammerer, Jr.
3,353,599 A * 11/1967 Swift ..... 166/278

(Continued)

FOREIGN PATENT DOCUMENTS

CA 2543886 4/2006

(Continued)

OTHER PUBLICATIONS

Halliburton Retrievable Service Tools, Cobra Frac® RR4-EV Packer, (2 pgs.) undated.

(Continued)

*Primary Examiner*—George Suchfield
(74) *Attorney, Agent, or Firm*—Marlin R. Smith

(57) ABSTRACT

Casing deformation and control for inclusion propagation in earth formations. A method of forming at least one inclusion in a subterranean formation includes the steps of: installing a liner within a casing section in a wellbore intersecting the formation; and expanding the liner and the casing section, thereby applying an increased compressive stress to the formation. Another method of forming the inclusion includes the steps of: installing an expansion control device on a casing section, the device including at least one latch member; expanding the casing section radially outward in a wellbore, the expanding step including widening at least one opening in a sidewall of the casing section, and displacing the latch member in one direction; and preventing a narrowing of the opening after the expanding step, the latch member resisting displacement thereof in an opposite direction.

20 Claims, 10 Drawing Sheets

U.S. PATENT DOCUMENTS 3,690,380 A 9/1972 Grable
3,727,688 A 4/1973 Clampitt
3,779,915 A 12/1973 Kucera
3,884,303 A 5/1975 Closmann
3,948,325 A 4/1976 Winston et al.
3,987,854 A 10/1976 Callihan et al.
4,005,750 A 2/1977 Shuck
4,018,293 A 4/1977 Keller
4,311,194 A 1/1982 White
4,834,181 A 5/1989 Uhri et al.
4,977,961 A 12/1990 Avasthi
5,010,964 A 4/1991 Cornette
5,036,918 A 8/1991 Jennings, Jr. et al.
5,103,911 A 4/1992 Heijnen
5,111,881 A 5/1992 Soliman et al.
5,211,714 A 5/1993 Jordan et al.
5,318,123 A 6/1994 Venditto et al.
5,325,923 A 7/1994 Surjaatmadja
5,335,724 A 8/1994 Venditto et al.
5,372,195 A 12/1994 Swanson et al.
5,386,875 A 2/1995 Venditto et al.
5,394,941 A 3/1995 Venditto et al.
5,396,957 A 3/1995 Surjaatmadja
5,431,225 A 7/1995 Abass et al.
5,472,049 A 12/1995 Chaffee et al.
5,494,103 A 2/1996 Surjaatmadja et al.
5,547,023 A 8/1996 McDaniel et al.
5,564,499 A 10/1996 Willis et al.
5,667,011 A * 9/1997 Gill et al. ..... 166/295
5,765,642 A 6/1998 Surjaatmadja
5,829,520 A 11/1998 Johnson
5,944,446 A 8/1999 Hocking
5,981,447 A 11/1999 Chang et al.
6,003,599 A 12/1999 Huber et al.
6,116,343 A 9/2000 Van Petegem et al.
6,142,229 A 11/2000 Branson, Jr. et al.
6,176,313 B1 * 1/2001 Coenen et al. ..... 166/280.1
6,216,783 B1 4/2001 Hocking et al.
6,283,216 B1 9/2001 Ohmer
6,330,914 B1 12/2001 Hocking et al.
6,443,227 B1 9/2002 Hocking et al.
6,446,727 B1 9/2002 Zemlak et al.
6,508,307 B1 1/2003 Almaguer
6,543,538 B2 4/2003 Tolman et al.
6,662,874 B2 12/2003 Surjaatmadja
6,719,054 B2 4/2004 Cheng et al.
6,722,437 B2 * 4/2004 Vercaemer et al. ..... 166/308.1
6,725,933 B2 4/2004 Middaugh et al.
6,732,800 B2 5/2004 Acock et al.
6,779,607 B2 8/2004 Middaugh et al.
6,782,953 B2 * 8/2004 Maguire et al. ..... 166/380
6,792,720 B2 9/2004 Hocking
6,991,037 B2 1/2006 Hocking
7,055,598 B2 6/2006 Ross et al.
7,066,284 B2 6/2006 Wylie et al.
7,069,989 B2 7/2006 Marmorshteyn
7,228,908 B2 6/2007 East, Jr. et al.
7,231,985 B2 6/2007 Cook et al.
7,240,728 B2 7/2007 Cook et al.
7,278,484 B2 10/2007 Vella et al.
7,412,331 B2 8/2008 Calhoun et al.
2002/0189818 A1 * 12/2002 Metcalfe ..... 166/382
2003/0075333 A1 4/2003 Vercaemer et al.
2003/0230408 A1 12/2003 Acock et al.
2004/0118574 A1 * 6/2004 Cook et al. ..... 166/384
2004/0173349 A1 9/2004 Pointing
2005/0194143 A1 * 9/2005 Xu et al. ..... 166/285
2005/0263284 A1 12/2005 Justus
2006/0118301 A1 6/2006 East, Jr. et al.
2006/0131074 A1 6/2006 Calhoun et al.
2006/0144593 A1 7/2006 Reddy
2006/0162923 A1 7/2006 Ware
2007/0114044 A1 5/2007 Brezinski et al.
2007/0199695 A1 8/2007 Hocking
2007/0199697 A1 8/2007 Hocking
2007/0199698 A1 8/2007 Hocking
2007/0199699 A1 8/2007 Hocking
2007/0199700 A1 8/2007 Hocking
2007/0199701 A1 8/2007 Hocking
2007/0199702 A1 8/2007 Hocking
2007/0199704 A1 8/2007 Hocking
2007/0199705 A1 8/2007 Hocking
2007/0199706 A1 8/2007 Hocking
2007/0199707 A1 8/2007 Hocking
2007/0199708 A1 8/2007 Hocking
2007/0199710 A1 8/2007 Hocking
2007/0199711 A1 8/2007 Hocking
2007/0199712 A1 8/2007 Hocking
2007/0199713 A1 8/2007 Hocking
2009/0032267 A1 2/2009 Cavender et al.

FOREIGN PATENT DOCUMENTS

EP 1131534 9/2003
WO 8100016 A1 1/1981
WO 0001926 1/2000
WO 0029716 5/2000
WO 2004092530 A2 10/2004
WO 2005065334 7/2005
WO 2007000956 9/2007
WO 2007012175 10/2007
WO 2007012199 10/2007
WO 2007017787 10/2007
WO 2007017810 10/2007
WO 2007017865 10/2007

OTHER PUBLICATIONS

U.S. Appl. No. 11/832,602, filed Aug. 1, 2007.
Halliburton Production Optimization, Cobra Frac® Service, (2 pgs.), dated Aug. 2005.
Halliburton Drawing No. D00004932, (2 pgs), dated Sep. 10, 1999.
Serata Geomechanics Corporation, "Stress/Property Measurements for Geomechanics," www.serata.com, dated 2005-2007.
ISTT, "Trenchless Pipe Replacement," (1 pg), dated Dec. 11, 2006.
ISTT, "Rerounding" (2 pgs), dated Dec. 11, 2006.
STAR Frac Completion System brochure, (4 pgs.), dated Winter/Spring 2006.
Wenlu Zhu, et al., "Shear-enhanced Compaction and Permeability Reduction: Triaxial Extension Tests on Porous Sandstone," Mechanics of Materials, (16 pgs.) dated 1997.
S.L. Karner, "What Can Granular Media Teach Us About Deformation in Geothermal Systems?" ARMA, dated 2005.
M.R. Coop, "The Mechanics of Uncemented Carbonate Sands," Geotechnique vol. 40, No. 4, (pp. 607-626), dated 1990.
M.R. Coop and J.H. Atkinson, "The Mechanics of Cemented Carbonate Sands," Geotechnique vol. 43, No. 1, (pp. 53-67), dated 1993.
T. Cuccovillo and M.R. Coop, "Yielding and Pre-failure Deformation of Structured Sands," Geotechnique vol. 47, No. 3, (pp. 491-508), dated 1997.
Lockner and Stanchits, "Undrained Pore-elastic Response of Sandstones to Deviatoric Stress Change," Porelastic Response of Sandstones, (30 pgs.) dated 2002.
Axel Kaselow and Serge Shapiro, "Stress Sensitivity of Elastic Moduli and Electrical Resistivity in Porous Rocks," Journal of Geophysics and Engineering, dated Feb. 11, 2004.
Lockner and Beeler, "Stress-Induced Anisotropic Porelasticity Response in Sandstone," dated Jul. 2003.
G.V. Rotta, et al., "Isotropic Yielding in an Artificially Cemented Soil Cured Under Stress," Geotechnique, vol. 53, No. 53, (pp. 493-501), dated 2003.
T.F. Wong and P. Baud, "Mechanical Compaction of Porous Sandstone," Oil and Gas Science and Technology, (pp. 715-727), dated 1999.
U.S. Appl. No. 11/610,819, filed Dec. 14, 2006.

U.S. Appl. No. 11/832,620, filed Aug. 1, 2007.
U.S. Appl. No. 11/832,615, filed Aug. 1, 2007.
U.S. Appl. No. 11/545,749, filed Oct. 10, 2006.
U.S. Appl. No. 11/753,314, filed May 24, 2007.
U.S. Appl. No. 11/977,772, filed Oct. 26, 2007.
Office Action issued Jan. 26, 2009, for U.S. Appl. No. 11/832,615, 23 pages.
International Search Report and Written Opinion issued Feb. 13, 2009, for International Patent Application No. PCT/US08/87346, 9 pages.
Office Action issued Feb. 2, 2009, for Canadian Patent Application Serial No. 2,596,201, 3 pages.
Office Action issued May 15, 2009, for U.S. Appl. No. 11/610,819, 26 pages.
Office Action issued Jun. 16, 2009, for U.S. Appl. No. 11/832,602, 37 pages.
Office Action issued Jun. 17, 2009, for U.S. Appl. No. 11/832,620, 37 pages.
International Search Report and Written Opinion issued Sep. 25, 2008, for International Patent Application PCT/US07/87291.
International Search Report and Written Opinion issued Oct. 8, 2008, for International Patent Application No. PCT/US08/070780, 8 pages.
Office Action issued Sep. 29, 2009, for U.S. Appl. No. 11/610,819, 12 pages.
Office Action issued Jan. 21, 2010, for U.S. Appl. No. 11/610,819, 11 pages.
International Preliminary Report on Patentability issued Feb. 11, 2010, for International Patent Application Serial No. PCT/US08/070756, 10 pages.
International Preliminary Report on Patentability issued Feb. 11. 2010, for International Patent Application Serial No. PCT/US08/070776, 8 pages.
International Search Report and Written Opinion issued Jul. 2, 2010, for International Patent Application Serial No. PCT/US09/63588, 15 pages.
International Preliminary Report on Patentability issued Jul. 8, 2010, for International Patent Application Serial No. PCT/US08/087346, 8 pages.

* cited by examiner

FIG.5
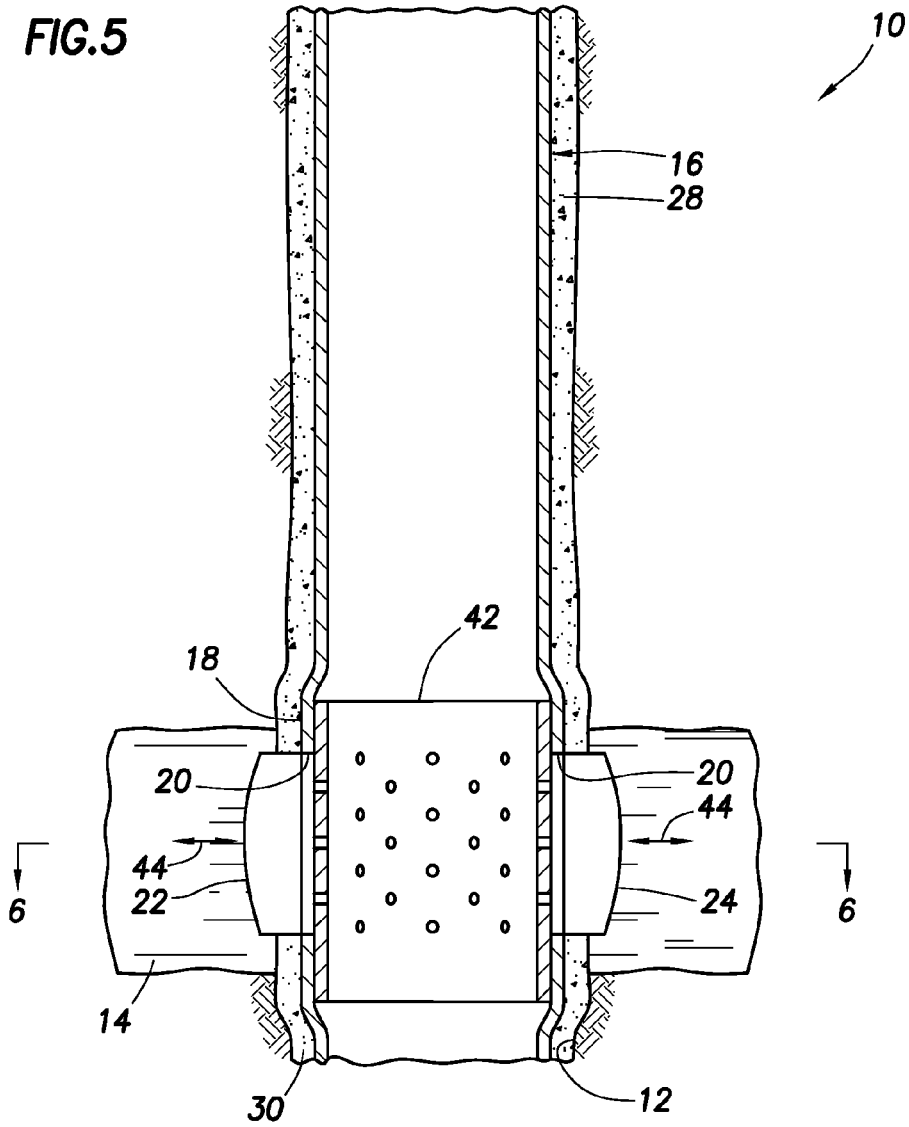
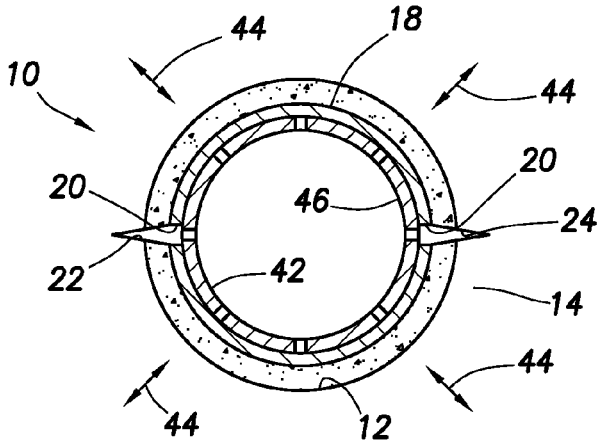
FIG.6

CASING DEFORMATION AND CONTROL FOR INCLUSION PROPAGATION

BACKGROUND

The present invention relates generally to equipment utilized and operations performed in conjunction with a subterranean well and, in an embodiment described herein, more particularly provides casing deformation and control for inclusion propagation in earth formations.

It is known in the art to install a special injection casing in a relatively shallow wellbore to form fractures extending from the wellbore in preselected azimuthal directions into a relatively unconsolidated or poorly cemented earth formation. The casing may be dilated and a fluid may be pumped into the injection casing to part the surrounding formation.

Unfortunately, these prior methods have required use of the special injection casings, and so are not applicable for use in existing wells having substantial depth. Furthermore, if the casing is dilated, it would be desirable to improve on methods of retaining the dilation of the casing, so that stress imparted to the formation remains while inclusions are formed in the formation.

Therefore, it may be seen that improvements are needed in the art. It is among the objects of the present disclosure to provide such improvements.

SUMMARY

In carrying out the principles of the present invention, various apparatus and methods are provided which solve at least one problem in the art. Examples are described below in which increased compressive stress is produced in a formation in order to propagate an inclusion into the formation. The increased compressive stress may be maintained utilizing an expanded liner and/or an expansion control device.

In one aspect, a method of forming at least one inclusion in a subterranean formation is provided. The method includes the steps of: installing a liner within a casing section in a wellbore intersecting the formation; and expanding the liner and the casing section, thereby applying an increased compressive stress to the formation.

In another aspect, a method of forming at least one inclusion in a subterranean formation includes the steps of: installing an expansion control device on a casing section, the device including at least one latch member; expanding the casing section radially outward in a wellbore, the expanding step including widening at least one opening in a sidewall of the casing section, and displacing the latch member in one direction; and preventing a narrowing of the opening after the expanding step, the latch member resisting displacement thereof in an opposite direction.

These and other features, advantages, benefits and objects of the present disclosure will become apparent to one of ordinary skill in the art upon careful consideration of the detailed description of representative embodiments of the invention hereinbelow and the accompanying drawings, in which similar elements are indicated in the various figures using the same reference numbers.

BRIEF DESCRIPTION OF THE DRAWINGS

FIG. 5 is a schematic cross-sectional view of the system, wherein the casing section and a liner therein have been expanded;

FIG. 6 is a schematic cross-sectional view of the system, taken along line 6-6 of FIG. 5;

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
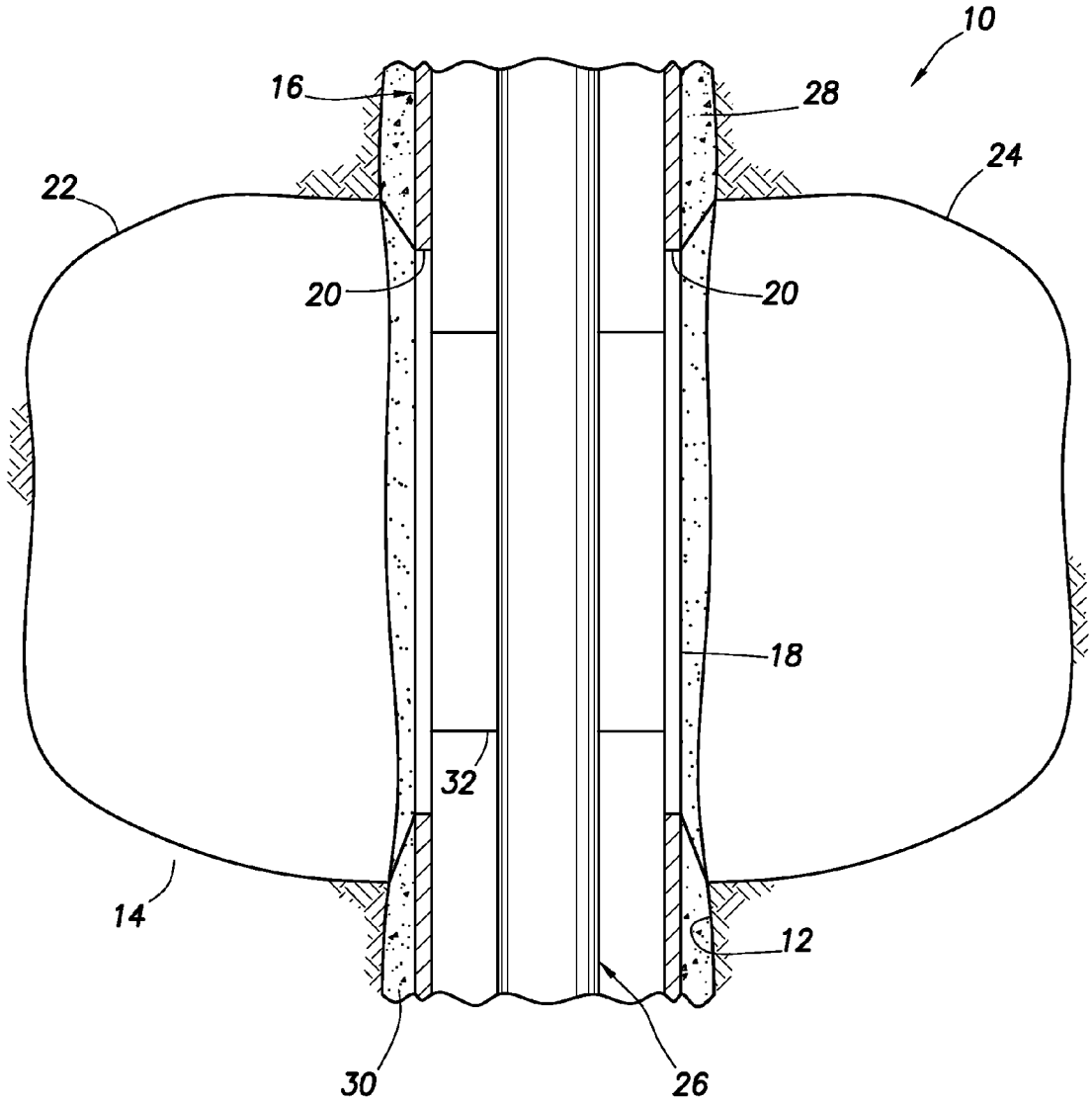
FIG. 1 is a schematic partially cross-sectional view of a well system and associated method embodying principles of the present invention.

Representatively illustrated in FIG. 1 is a well system 10 and associated method which embody principles of the present invention. A wellbore 12 has been drilled intersecting a subterranean zone or formation 14. The wellbore 12 is lined with a casing string 16 which includes a casing section 18 extending through the formation 14.

As used herein, the term "casing" is used to indicate a protective lining for a wellbore. Casing can include tubular elements such as those known as casing, liner or tubing. Casing can be substantially rigid, flexible or expandable, and can be made of any material, including steels, other alloys, polymers, etc.

As depicted in FIG. 1, longitudinally extending openings 20 are formed through a sidewall of the casing section 18. These openings 20 provide for fluid communication between the formation 14 and an interior of the casing string 16. The openings 20 may or may not exist in the casing section 18 sidewall when the casing string 16 is installed in the wellbore 12.

Generally planar inclusions 22, 24 extend radially outward from the wellbore 12 in predetermined directions. These inclusions 22, 24 may be formed simultaneously, or in any order. The inclusions 22, 24 may not be completely planar or flat in the geometric sense, in that they may include some curved portions, undulations, tortuosity, etc., but preferably the inclusions do extend in a generally planar manner outward from the wellbore 12.

The inclusions 22, 24 may be merely inclusions of increased permeability relative to the remainder of the formation 14, for example, if the formation is relatively unconsolidated or poorly cemented. In some applications (such as in formations which can bear substantial principal stresses), the inclusions 22, 24 may be of the type known to those skilled in the art as "fractures." The inclusions 22, 24 may result from relative displacements in the material of the formation 14, from washing out, etc.

The inclusions 22, 24 preferably are azimuthally oriented in preselected directions relative to the wellbore 12. Although the wellbore 12 and inclusions 22, 24 are vertically oriented as depicted in FIG. 1, they may be oriented in any other direction in keeping with the principles of the invention. Although two of the inclusions 22, 24 are illustrated as being spaced apart 180 degrees from each other, any number (including one) and spacing of inclusions (including zero degrees) may be used in keeping with the principles of the invention.

A tool string 26 is installed in the casing section 18. The tool string 26 is preferably interconnected to a tubular string (such as a coiled tubing string or production tubing string, etc.) used to convey and retrieve the tool string. The tool string 26 may, in various embodiments described below, be used to expand the casing section 18, form or at least widen the openings 20, form or initiate the inclusions 22, 24 and/or accomplish other functions.

One desirable feature of the tool string 26 and casing section 18 is the ability to preserve a sealing capability and structural integrity of cement or another hardened fluid 28 in an annulus 30 surrounding the casing section. By preserving the sealing capability of the hardened fluid 28, the ability to control the direction of propagation of the inclusions 22, 24 is enhanced. By preserving the structural integrity of the hardened fluid 28, production of debris into the casing string 16 is reduced.

To accomplish these objectives, the tool string 26 includes a casing expander 32. The casing expander 32 is used to apply certain desirable stresses to the hardened fluid 28 and formation 14 prior to propagating the inclusions 22, 24 radially outward.

In this manner, a desired stress regime may be created and stabilized in the formation 14 before significant propagation of the inclusions 22, 24, thereby imparting much greater directional control over the propagation of the inclusions. It will be readily appreciated by those skilled in the art that, especially in relatively unconsolidated or poorly cemented formations, the stress regime existing in a formation is a significant factor in determining the direction in which an inclusion will propagate.

An acceptable tool string 26 and casing expander 32 for use in the system 10 and associated method are described in U.S. patent application Ser. No. 11/610,819 filed Dec. 14, 2006. Other applicable principles of casing expansion and propagation of inclusions in earth formations are described in U.S. patent application Ser. Nos. 11/832,602, 11/832,620 and 11/832,615 filed Aug. 1, 2007. The entire disclosure of each of the above prior applications is incorporated herein by this reference.

At this point it should be clearly understood that the invention is not limited in any manner to the details of the well system 10 and associated method described herein. The well system 10 and method are merely representative of a wide variety of applications which may benefit from the principles of the invention.

Referring additionally now to FIGS. 2-8, the system 10 and associated method are representatively illustrated after successive steps of the method have been performed. In this embodiment of the method, the openings 20 are formed by perforating the casing section 18. Other techniques for forming the openings 20 (such as jet cutting, pre-forming the openings, etc.) may be used in keeping with the principles of the invention.

Figure 2:
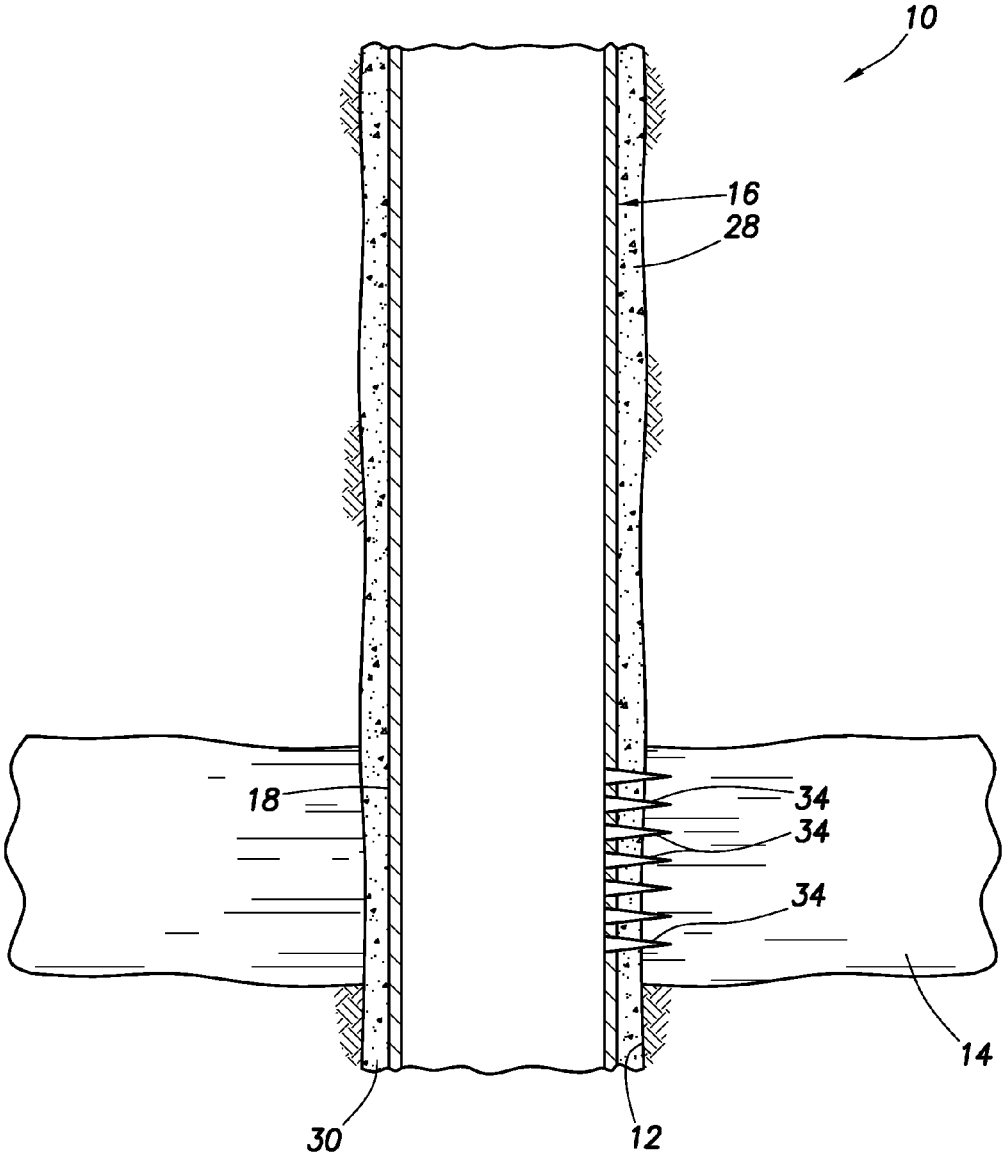
FIG. 2 is a schematic cross-sectional view of the system, wherein a casing section has been perforated.

As depicted in FIG. 2, the openings 20 have not yet been formed. However, perforations 34 have been formed outwardly through the casing section 18 and cement 28, and partially into the formation 14.

The perforations 34 are preferably formed along a desired line of intersection between the inclusion 24 and the casing section 18. The perforations 34 may be formed by, for example, lowering a perforating gun or other perforating device into the casing section 18.

Only one line of the perforations 34 is depicted in FIG. 2. Additional lines of perforations 34 may be formed (see FIG. 3, for example) as desired. For maximum density of the perforations 34 along each line of desired intersection between an inclusion and the casing section 18, it is preferred that one line of perforations be formed at a time, but multiple lines of perforations may be formed simultaneously if desired.

Figure 3:
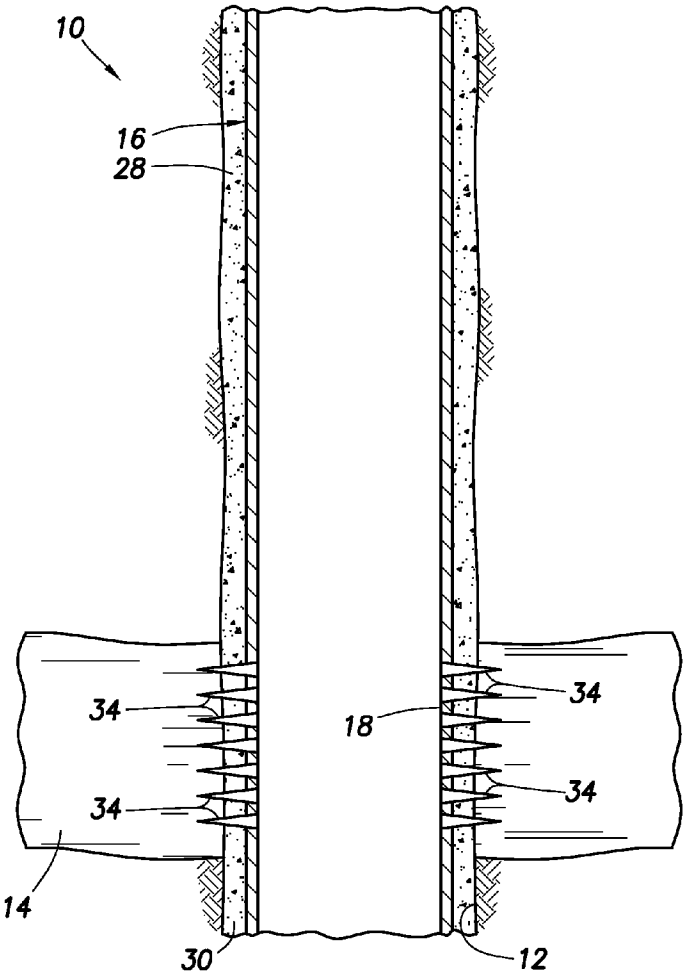
FIG. 3 is a schematic cross-sectional view of the system, wherein the casing section has been perforated in multiple orientations.

In FIG. 3, two lines of perforations 34 have been formed, in preparation for later forming of the openings 20 and inclusions 22, 24. It will be appreciated, however, that only one line of perforations 34 may be used (if it is desired to form only the one inclusion 24 in the formation 14), or any other number of lines of perforations could be used. If multiple lines of perforations 34 are used, they could be equally radially spaced apart (i.e., by 180 degrees if two lines are used, by 120 degrees if three lines are used, by 90 degrees if four lines are used, etc.), or any other spacings may be used as desired.

Figure 4:
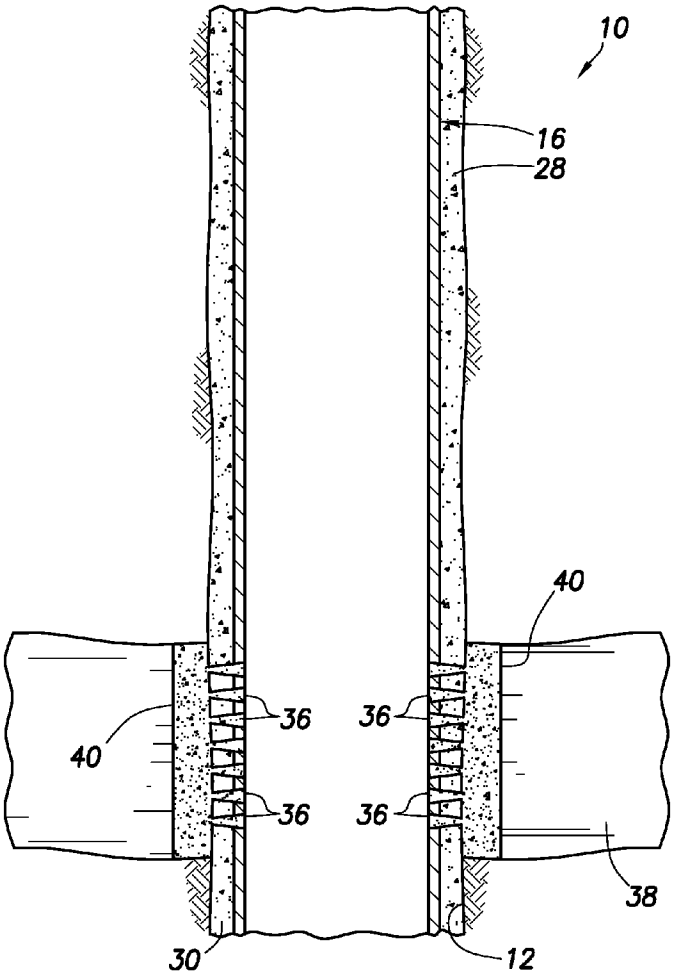
FIG. 4 is a schematic cross-sectional view of the system, wherein pre-existing perforations have been squeezed off.

Turning now to FIG. 4, it may be beneficial in some circumstances to close off any pre-existing perforations 36 which may have previously been formed into the formation 14 or another (perhaps adjacent) formation or zone 38. For example, it may be desired to utilize application of pressure to fire perforating guns, expand the casing section 18, etc., and the pre-existing perforations 36 might interfere with these operations. More importantly, the presence of the perforations 36 could interfere with proper initiation and propagation of the inclusions 22, 24, as described more fully below.

As depicted in FIG. 4, the perforations 36 have been squeezed off with cement 40. The perforations 36 may be squeezed off before or after the perforations 34 are formed.

As used herein, the term "cement" indicates a hardenable fluid or slurry which may be used for various purposes, for example, to seal off a fluid communication path (such as a perforation or a well annulus), stabilize an otherwise unstable structure (such as the exposed face of an unconsolidated formation) and/or secure a structure (such as a casing) in a wellbore. Cement is typically comprised of a cementitious material, but could also (or alternatively) comprise polymers, gels, foams, additives, composite materials, combinations of these, etc.

If the zone 38 is actually part of the formation 14, it may be desirable to inject the cement 40 with sufficient pressure to displace the formation radially outward (as shown in FIG. 4) and thereby increase compressive stress in the formation in a radial direction relative to the wellbore 12. Such increased radial compressive stress can later aid in maintaining proper orientation of the inclusions 22, 24.

Furthermore, if the zone 38 is part of the formation 14, the perforations 36 may correspond to the perforations 34, and the cement 40 may be used not only to increase compressive stress in the formation, but also to prevent disintegration of the hardened fluid 28 (breaking up of the hardened fluid which would result in debris entering the casing section 18). For this purpose, the cement 40 could be a relatively flexible composition having some elasticity so that, when the casing section 18 is expanded, the cement injected about the hardened fluid 28 will prevent the hardened fluid from breaking up other than along the lines of perforations 34.

Referring additionally now to FIGS. 5 & 6, the system 10 is representatively illustrated after a liner 42 has been installed in the casing section 18, and both of the liner and casing section have been expanded radially outward. At this point, the inclusions 22, 24 may also be initiated somewhat radially outward into the formation 14.

Expansion of the casing section 18 in this example results in parting of the casing section along the lines of perforations 34, thereby forming the openings 20. Another result of expanding the casing section 18 is that increased compressive stress 44 is applied to the formation 14 in a radial direction relative to the wellbore 12. As discussed above, the cement 40 may be injected about the hardened fluid 28 to prevent it from breaking up (other than along the lines of perforations 34) when the casing section 18 is expanded.

It is known that fractures or inclusions preferentially propagate in a plane orthogonal to the direction of minimum stress. Where sufficient overburden stress exists (as in relatively deep hydrocarbon and geothermal wells, etc.), the increased radial compressive stress 44 generated in the system 10 ensures that the minimum stress will be in a tangential direction relative to the wellbore 12, thereby also ensuring that the inclusions 22, 24 will propagate in a radial direction (orthogonal to the minimum stress).

The liner 42 is also expanded within the casing section 18. Preferably, the liner 42 and casing section 18 are expanded at the same time, but this is not necessary.

One function performed by the liner 42 in the system 10 is to retain the expanded configuration of the casing section 18, i.e., to prevent the casing section from retracting radially inward after it has been expanded. This also maintains the increased compressive stress 44 in the formation 14 and prevents the openings 20 from closing or narrowing.

Preferably, the liner 42 is of the type known to those skilled in the art as an expandable perforated liner, although other types of liners may be used. The liner 42 preferably has a non-continuous sidewall 46 (e.g., perforated and/or slotted, etc.) with openings therein permitting fluid communication through the sidewall.

In this manner, the liner 42 can also permit fluid communication between the formation 14 and the interior of the casing section 18 and casing string 16. This fluid communication may be permitted before, during and/or after the expansion process.

Expansion of the casing section 18 and liner 42 may be accomplished using any known methods (such as mechanical swaging, application of pressure, etc.), or any methods developed in the future.

Figure 7:
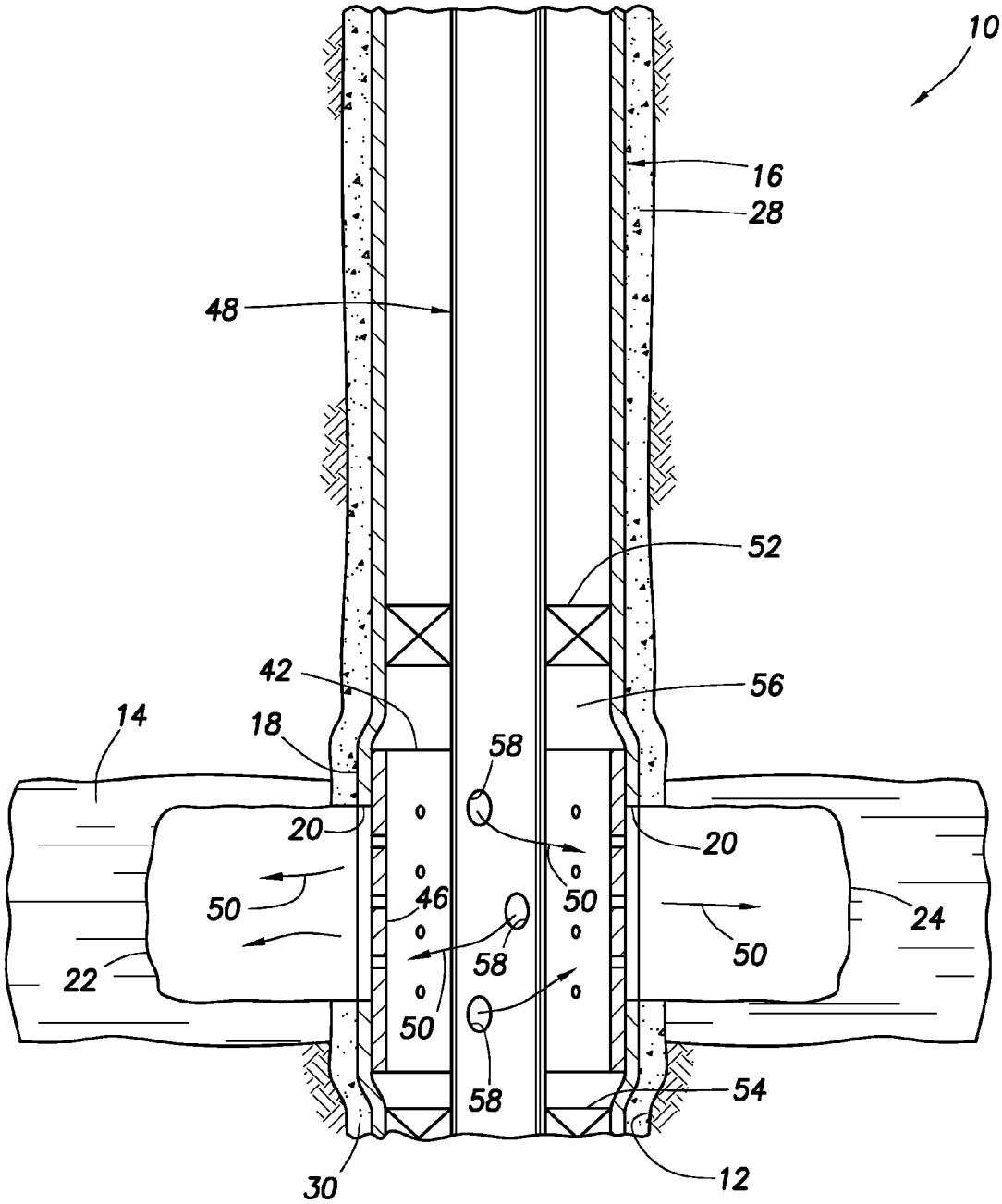
FIG. 7 is a schematic cross-sectional view of the system, wherein inclusions are being propagated into a formation.

Referring additionally now to FIG. 7, the system 10 is representatively illustrated after a fluid injection assembly 48 has been positioned within the casing string 16. One function of the assembly 48 is to inject fluid 50 through the openings 20 and into the formation 14 in order to propagate the inclusions 22, 24 radially outward.

As depicted in FIG. 7, the assembly 48 includes two packers 52, 54 which straddle the casing section 18 to seal off an annulus 56 radially between the assembly and the casing section. The fluid 50 can now be delivered via ports 58 in the assembly between the packers 52, 54.

The fluid 50 flows under pressure through the openings 20 and into the formation 14 to propagate the inclusions 22, 24. The mechanism of such propagation in unconsolidated and/or weakly cemented formations is documented in the art (such as in the incorporated applications referenced above), and so will not be further described herein. However, it is not necessary for the formation 14 to be unconsolidated or weakly cemented in keeping with the principles of the invention.

Figure 8:
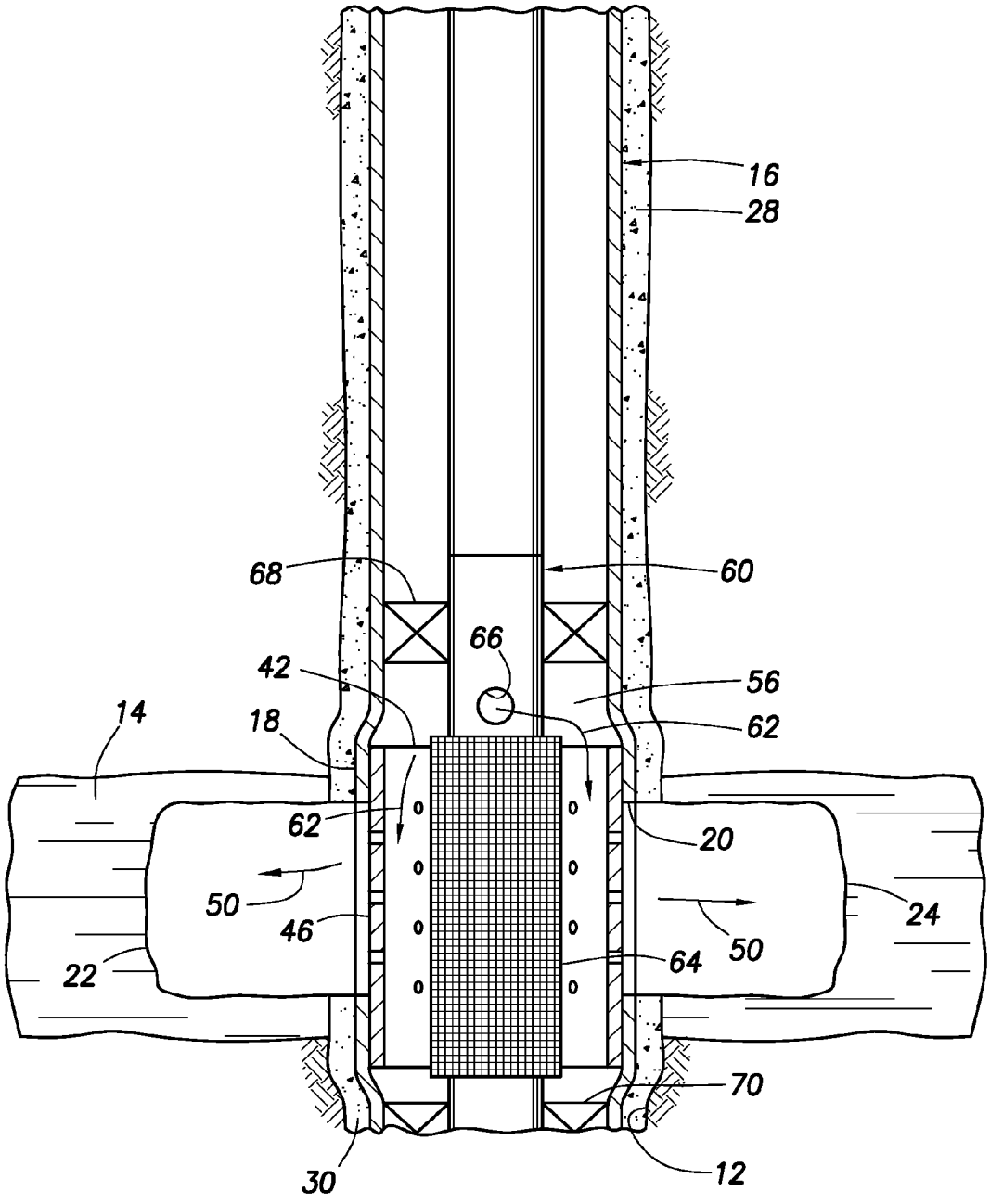
FIG. 8 is a schematic cross-sectional view of the system, wherein a gravel packing operation is being performed.

Referring additionally now to FIG. 8, the system 10 is representatively illustrated after a gravel packing assembly 60 has been installed in the casing string 16. The gravel packing assembly 60 is a type of fluid injection assembly which may be used in place of, or subsequent to, use of the fluid injection assembly 48 described above. That is, the gravel packing assembly 60 may be used to inject the fluid 50 into the formation 14 for propagation of the inclusions 22, 24, but the gravel packing assembly is specially configured to also deliver a gravel slurry 62 into the annulus 56 radially between the casing section 18 and a well screen 64 of the assembly.

Preferably, the gravel slurry 62 is flowed into the annulus 56 in a gravel packing operation which follows injection of the fluid 50 into the formation 14 to propagate the inclusions 22, 24, although these operations could be performed simultaneously (or in any other order) if desired. The gravel slurry 62 is flowed outward from a port 66 positioned between packers 68, 70 of the assembly 60 which straddle the casing section 18. The port 66 may be part of a conventional gravel packing crossover.

Gravel which is deposited in the annulus 56 about the screen 64 in the gravel packing operation will serve to reduce flow of formation sand and fines along with produced fluids from the formation 14. This will be particularly beneficial in cases in which the formation 14 is unconsolidated and/or weakly cemented.

It can now be fully appreciated that the system 10 and associated method provide for convenient and controlled propagation of the inclusions 22, 24 into the formation 14 in situations in which the casing string 16 is pre-existing in the well. That is, the casing section 18 was not previously provided with any expansion control device or facility for forming the openings 20, etc. Instead, the casing section 18 could be merely a conventional portion of the pre-existing casing string 16.

Figure 9:
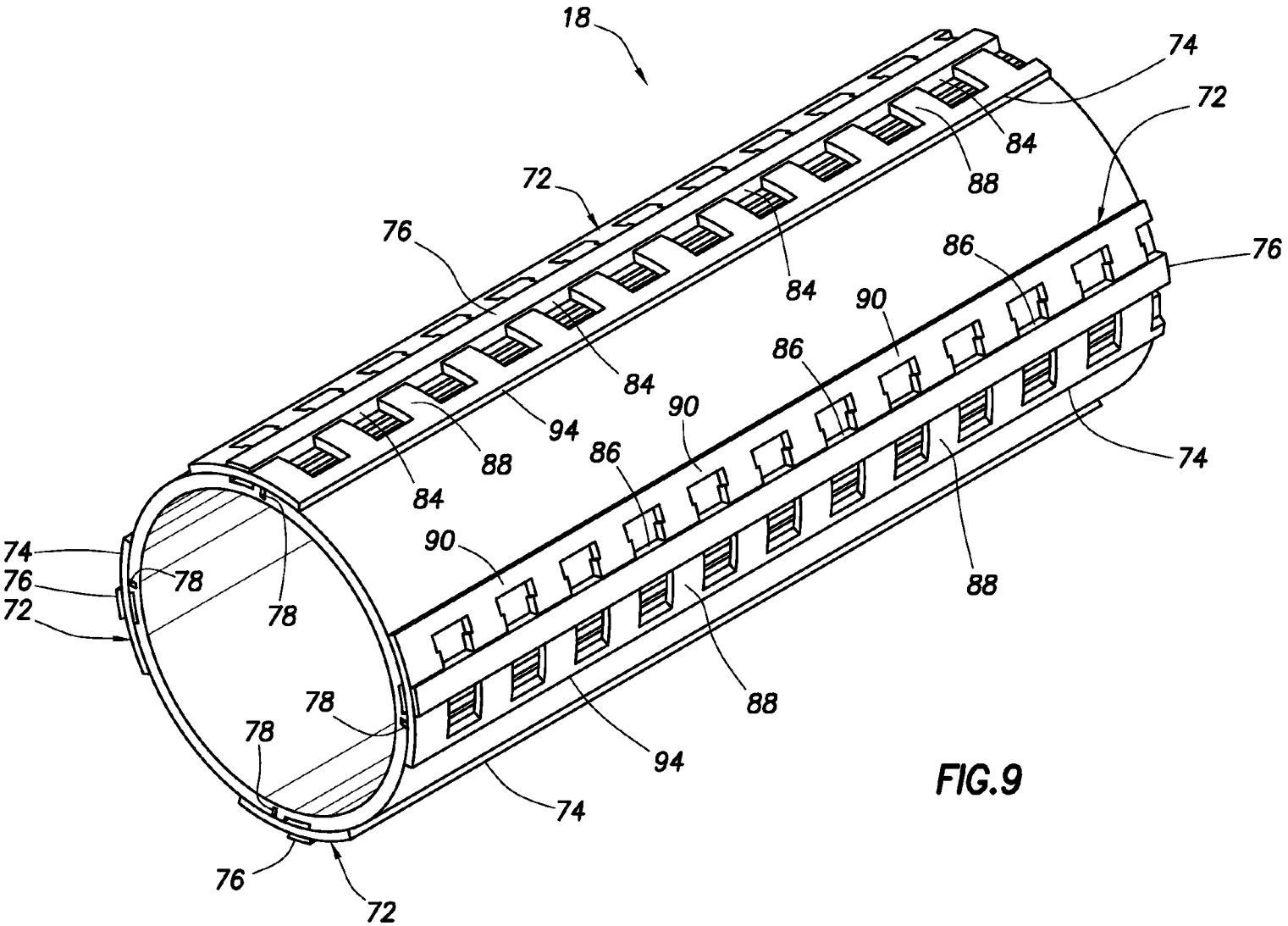
FIG. 9 is a schematic isometric view of an alternate configuration of the casing section, wherein an expansion control device is attached to the casing section.

Referring additionally now to FIG. 9, an alternate configuration of the casing section 18 is representatively illustrated. In this configuration, the casing section 18 does include multiple expansion control devices 72, as well as provisions for forming the openings 20 when the casing section is expanded. Only a short portion of the casing section 18 is depicted in FIG. 9 for illustration purposes, so it should be understood that the casing section may be provided in any desired length.

The casing section 18 of FIG. 9 is intended for those situations in which the casing section can be interconnected as part of a casing string 16 to be installed in the wellbore 12. That is, the casing string 16 is not already pre-existing in the well.

In that case, the relatively flexible cement 40 described above is preferably used to secure and seal the casing section 18 of FIG. 9 in the wellbore 12 without prior use of the hardened fluid 28 about the casing section. Stated differently, the flexible cement 40 could take the place of the hardened fluid 28 about the exterior of the casing section 18. In this manner, breaking up of the hardened fluid 28 will not be of concern when the casing section 18 is expanded.

Each of the expansion control devices 72 includes a latch structure 74 and an abutment structure 76. The latch structure 74 and abutment structure 76 are attached to an exterior of the casing section 18 (for example, by welding) on opposite sides of longitudinal slots 78 formed on the exterior of the casing section.

Figure 13:
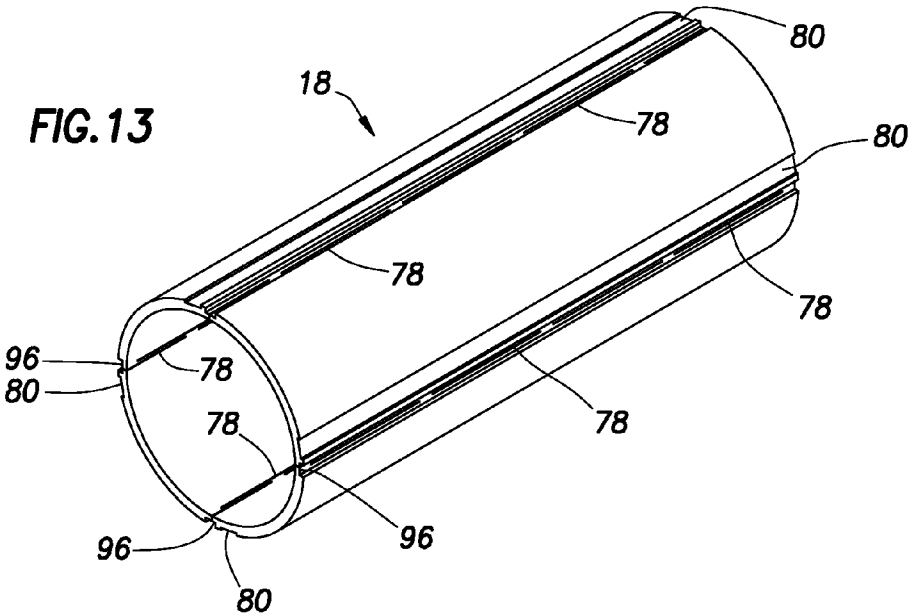
FIGS. 13-15 are schematic views of another alternate configuration of the casing section.
Figure 15:
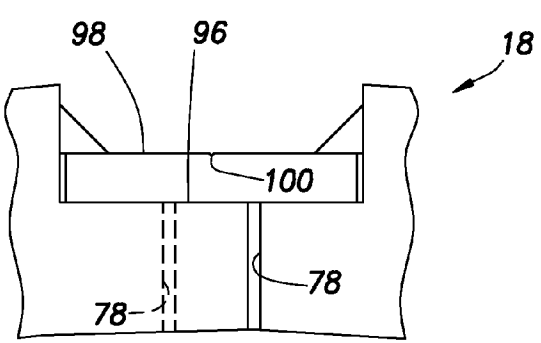
Figure 14:
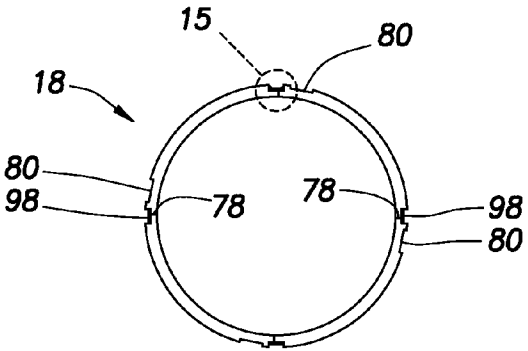

The slots 78 are used to weaken the casing section 18 along desired lines of intersection between the casing section and inclusions to be formed in the formation 14. As depicted in FIG. 9, there are four equally spaced sets of the slots 78, with four corresponding expansion control devices 72 straddling the slots, but any number and spacing of the slots and devices may be used in keeping with the principles of the invention. For example, an alternate configuration of the slots 78, with the slots extending completely through a sidewall of the casing section 18, is depicted in FIGS. 13-15.

When the casing section 18 is expanded, the slots 78 will allow the casing section to part along the desired lines of intersection of the inclusions with the casing section (thereby forming the openings 20), and the devices 72 will prevent subsequent narrowing of the openings. The devices 72 maintain the expanded configuration of the casing section 18, thereby also maintaining the increased compressive stress 44 in the formation 14.

Figure 10:
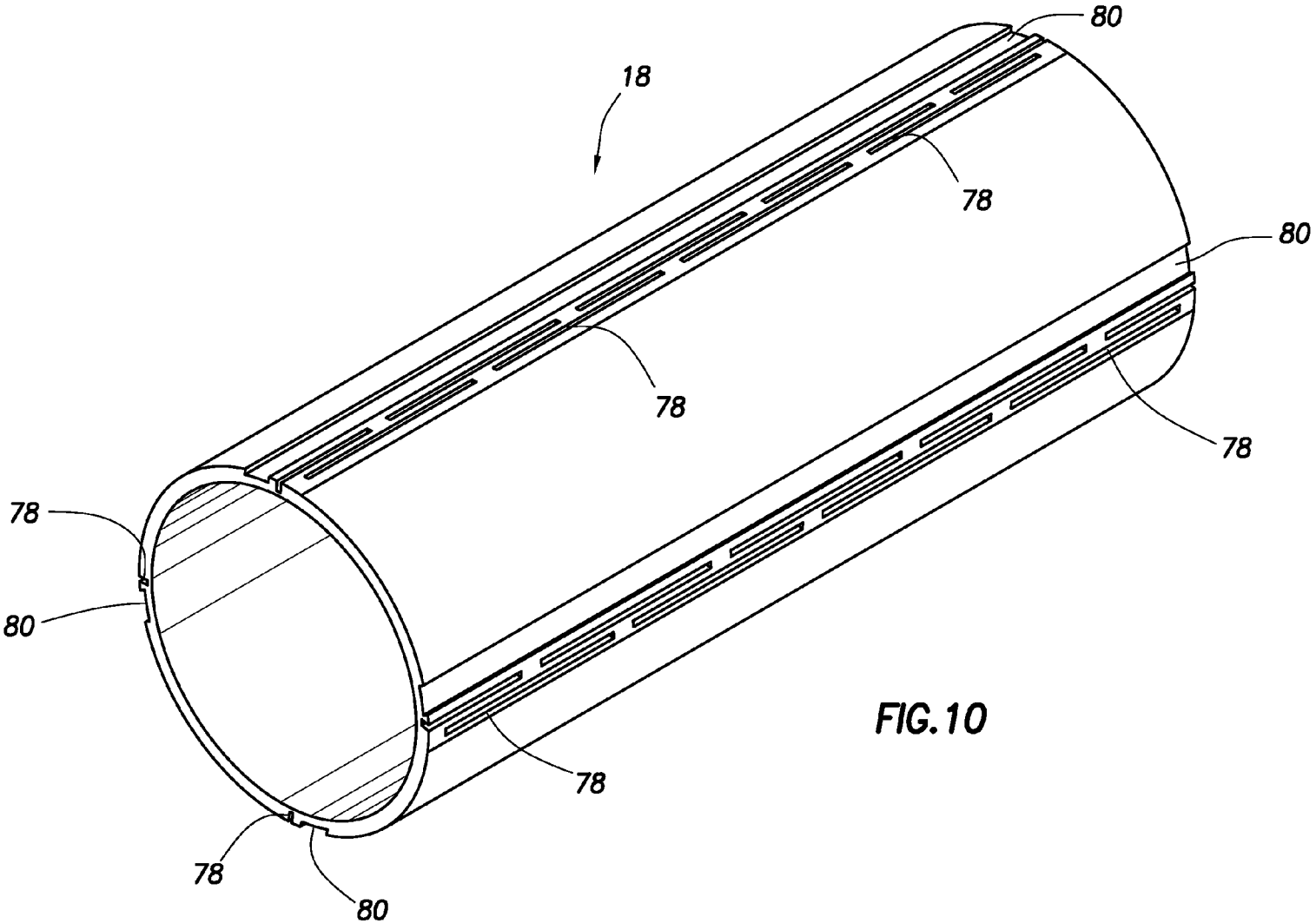
FIG. 10 is a schematic isometric view of the casing section apart from the expansion control device.

Referring additionally now to FIG. 10, the casing section 18 is representatively illustrated prior to attaching the devices 72 thereto. Note that the slots 78 are formed in two offset series of individual slots, but any configuration of the slots may be used as desired.

Adjacent each set of the slots 78 is a longitudinal recess 80. The abutment structure 76 is received in the recess 80 when the device 72 is attached to the casing section 18.

Figure 11:
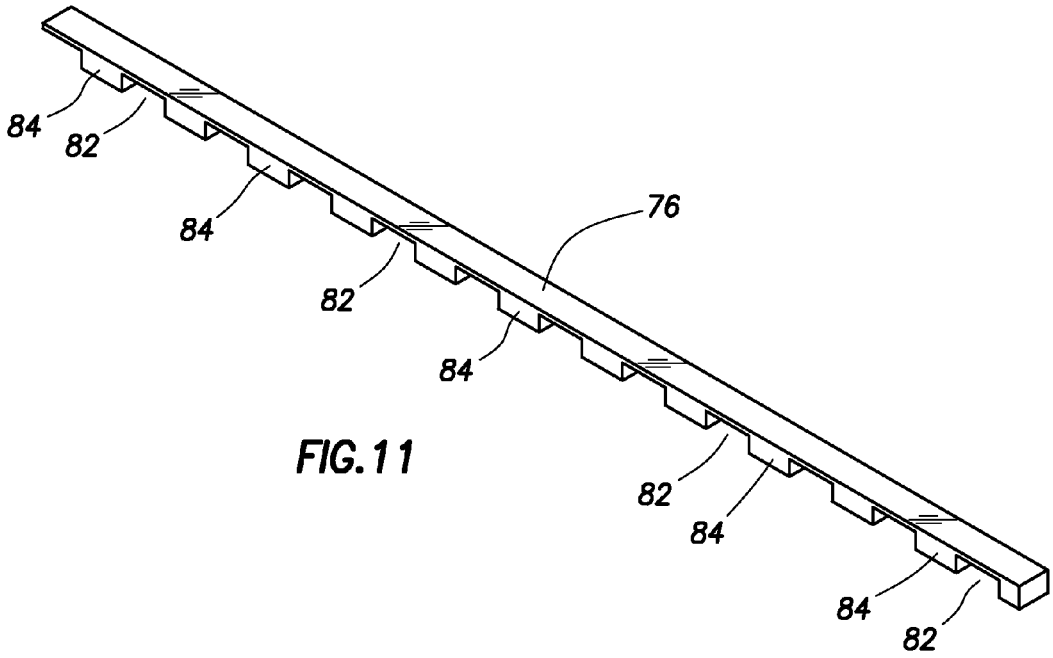
FIG. 11 is a schematic isometric view of an abutment structure of the expansion control device.

Referring additionally now to FIG. 11, the abutment structure 76 is representatively illustrated apart from the casing section 18. In this view it may be seen that the abutment structure 76 includes multiple apertures 82, with shoulders 84 between the apertures. Similar (but oppositely facing) shoulders 86 are formed on an opposite side of the abutment structure 76, but are not visible in FIG. 11 (see FIG. 9).

Figure 12:
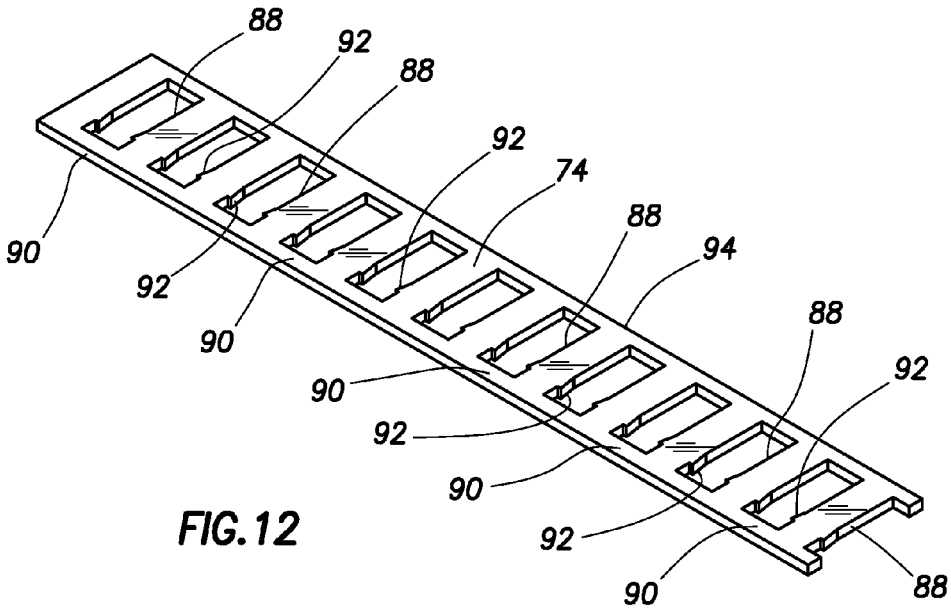
FIG. 12 is a schematic isometric view of a latch structure of the expansion control device.

Referring additionally now to FIG. 12, the latch structure 74 is representatively illustrated apart from the remainder of the casing section 18. In this view it may be seen that the latch structure 74 includes multiple latch members 88 and multiple stop members 90. As depicted in FIG. 12, the latch members 88 and stop members 90 are integrally formed from a single piece of material, but they could be separately formed if desired.

Each of the latch members 88 includes laterally extending projections 92. Other than at the projections 92, the latch members 88 are sufficiently narrow to fit within the apertures 82 as depicted in FIG. 9.

When the device 72 is attached to the casing section 18, the latch structure 74 is secured to the casing section along one edge 94, and the abutment structure 76 is secured in the recess 80, with the latch members 88 extending through the apertures 82.

When the casing section 18 is expanded, the latch members 88 (including projections 92) are drawn through the apertures 82, until the projections are displaced to the opposite side of the abutment structure 76. This expansion is limited by engagement between the stop members 90 and the shoulders 86 of the abutment structure 76.

Note that it is not necessary for the latch members 88 or projections 92 to be drawn completely through the apertures 82. For example, the latch members 88 could be drawn only partially through the apertures 82, and an interference fit between the projections 92 and the apertures could function to prevent subsequent narrowing of the openings 20 and thereby maintain the expanded configuration of the casing section 18. Other configurations of the latch members 88 and apertures 82 could also be used for these purposes.

The slots 78 form parting lines along the casing section 18, thereby forming the openings 20. After the expansion process is completed, narrowing of the openings 20 is prevented by engagement between the shoulders 84 on the abutment structure 76 and the projections 92 on the latch members 88.

In this manner, expansion of the casing section 18 and increased compressive force 44 in the formation 14 are maintained. This result is obtained in a convenient, economical and robust configuration of the casing section 18 which can be installed in the wellbore 12 using conventional casing installation practices.

Referring additionally now to FIGS. 13-15, another alternate configuration of the casing section 18 is representatively illustrated. The casing section 18 as depicted in FIG. 13 is similar in many respects to the casing section of FIG. 10.

However, in the configuration of FIG. 13, the slots 78 extend completely through a sidewall of the casing section 18. The slots 78 are shown arranged in four sets about the casing section 18, each set including two lines of the slots, and each line including multiple spaced apart slots, with the slots being staggered from one line to the next. Other arrangements, numbers, configurations, etc. of slots 78 may be used in keeping with the principles of the invention.

The slots 78 are preferably cut through the sidewall of the casing section 18 using a laser cutting technique. However, other techniques (such as cutting by water jet, saw, torch, etc.) may be used if desired.

The slots 78 extend between an interior of the casing section 18 and longitudinal recesses 96 formed on the exterior of the casing section. In FIG. 14 it may be seen that a strip 98 of material is received in each of the recesses 96. In FIG. 15 it may be seen that each outer edge of the strip 98 is welded to the casing section 18 in the recess 96.

A longitudinal score or groove 100 is formed longitudinally along an exterior of the strip 98. The groove 100 ensures that, when the strip parts as the casing section 18 is expanded, the strip 98 will split in a consistent, uniform manner.

The use of the strip 98 accomplishes several desirable functions. For example, the strip 98 closes off the slots 78 to thereby prevent fluid communication through the sidewall of the casing section 18 prior to the expansion process. Furthermore, the strip 98 can be manufactured of a material, thickness, shape, etc. which ensure consistent and predictable parting thereof when the casing section 18 is expanded.

The casing section 18 of FIGS. 13-15 would in practice be provided with the expansion control devices 72 as depicted in FIG. 9. Of course, other types of expansion control devices may be used in keeping with the principles of the invention.

In each of the embodiments described above, any number of the casing sections 18 may be used. For example, in the well system 10, the casing string 16 could include multiple casing sections 18. If multiple casing sections 18 are used, then corresponding multiple liners 42 may also be used in the embodiment of FIGS. 2-8.

Each casing section 18 may also have any length and any type of end connections as desired and suitable for the particular circumstances. Each casing section 18 may be made of material known to those skilled in the art by terms other than "casing," such as tubing, liner, etc.

It may now be fully appreciated that the above description of the system 10 and associated methods provides significant advancements in the art. In one described method of forming at least one inclusion 22, 24 in a subterranean formation 14, the method may include the steps of: installing a liner 42 within a casing section 18 in a wellbore 12 intersecting the formation 14; and expanding the liner 42 and the casing section 18, thereby applying an increased compressive stress 44 to the formation.

The method may include the step of perforating the casing section 18 along at least one desired line of intersection between the inclusion 22, 24 and the casing section. The perforating step may weaken the casing section 18 along the line of intersection, and the expanding step may include parting the casing section along the weakened line of intersection.

The liner 42 may include a non-continuous sidewall 46. The method may include producing fluid from the formation 14 to an interior of the casing section 18 via the liner sidewall 46. The method may include injecting fluid 50 into the formation 14 from the interior of the casing section 18 via the liner sidewall 46 to thereby propagate the inclusion 22, 24 into the formation.

The expanding step may include widening at least one opening 20 in the casing section 18, and the liner 42 may be utilized to prevent narrowing of the opening after the expanding step. The liner 42 may be utilized to outwardly support the expanded casing section 18 after the expanding step. The liner 42 may be utilized to maintain the compressive stress 44 in the formation 14 after the expanding step.

The method may include gravel packing an annulus 56 formed between the liner 42 and a well screen 64.

The casing section 18 may be a portion of a pre-existing casing string 16, whereby the casing section is free of any expansion control device prior to installation of the liner 42.

The method may include the step of injecting a flexible cement 40 external to the casing section 18 prior to expanding the casing section.

Another method of forming at least one inclusion 22, 24 in a subterranean formation 14 may include the steps of: installing an expansion control device 72 on a casing section 18, the device including at least one latch member 88; expanding the casing section 18 radially outward in the wellbore 12, the expanding step including widening at least one opening 20 in a sidewall of the casing section 18, and displacing the latch member 88 in one direction; and preventing a narrowing of the opening 20 after the expanding step, the latch member 88 resisting displacement thereof in an opposite direction.

The expanding step may include forming the opening 20 through a sidewall of the casing section 18. The expanding step may include limiting the width of the opening 20. The width limiting step may include engaging a stop member 90 with a shoulder 86. The stop member 90 and latch member 88 may be integrally formed.

The latch member 88 may be attached to the casing section 18 on one side of the opening 20, and at least one shoulder 84 may be attached to the casing section 18 on an opposite side of the opening 20. The resisting displacement step may include the latch member 88 engaging the shoulder 84. The shoulder 84 may be formed adjacent at least one aperture 82 in the device 72, and the expanding step may include drawing the latch member 88 through the aperture 82.

The shoulder 84 may be formed on an abutment structure 76 of the device 72 attached to the casing section 18. The abutment structure 76 may include multiple shoulders 84, 86 and apertures 82 extending longitudinally along the casing section 18. The device 72 may include multiple latch members 88 configured for engagement with the multiple shoulders 84.

The method may include the step of positioning a flexible cement 40 external to the casing section 18 prior to expanding the casing section.

The expanding step may include forming the opening 20 by parting the casing section 18 sidewall along at least one slot 78 formed in the sidewall. The slot 78 may extend only partially through the casing section 18 sidewall. The slot 78 may extend completely through the casing section 18 sidewall. A separate strip 98 of material may extend across the slot 78, and the expanding step may include parting the strip.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A method of forming at least one inclusion in a subterranean formation, the method comprising the steps of:

installing at least one liner within at least one casing section in a wellbore intersecting the formation;

expanding the liner and the casing section, thereby applying an increased compressive stress to the formation; and perforating the casing section along at least one desired line of intersection between the inclusion and the casing section.

2. The method of claim 1, wherein the perforating step weakens the casing section along the line of intersection, and wherein the expanding step further comprises parting the casing section along the weakened line of intersection.

3. The method of claim 1, wherein the liner comprises a non-continuous sidewall, and further comprising the step of producing fluid from the formation to an interior of the casing section via the liner sidewall.

4. The method of claim 1, wherein the liner comprises a non-continuous sidewall, and further comprising the step of injecting fluid into the formation from an interior of the casing section via the liner sidewall to thereby propagate the inclusion into the formation.

5. The method of claim 1, wherein the expanding step further comprises widening at least one opening in the casing section, and further comprising the step of the liner preventing narrowing of the opening after the expanding step.

6. The method of claim 1, further comprising the step of the liner outwardly supporting the expanded casing section after the expanding step.

7. The method of claim 1, further comprising the step of the liner maintaining the compressive stress in the formation after the expanding step.

8. The method of claim 1, further comprising the step of gravel packing an annulus formed between the liner and a well screen.

9. The method of claim 1, wherein the casing section is a portion of a pre-existing casing string, whereby the casing section is free of any expansion control device prior to installation of the liner.

10. The method of claim 1, further comprising the step of injecting a flexible cement external to the casing section prior to the expanding step.

11. A method of forming at least one inclusion in a subterranean formation, the method comprising the steps of:

installing at least one liner within at least one casing section in a wellbore intersecting the formation, the liner comprising a non-continuous sidewall;

expanding the liner and the casing section, thereby applying an increased compressive stress to the formation; and injecting fluid into the formation from an interior of the casing section via the liner sidewall to thereby propagate the inclusion into the formation.

12. The method of claim 11, further comprising the step of perforating the casing section along at least one desired line of intersection between the inclusion and the casing section.

13. The method of claim 12, wherein the perforating step weakens the casing section along the line of intersection, and wherein the expanding step further comprises parting the casing section along the weakened line of intersection.

14. The method of claim 11, further comprising the step of producing fluid from the formation to an interior of the casing section via the liner sidewall.

15. The method of claim 11, wherein the expanding step further comprises widening at least one opening in the casing section, and further comprising the step of the liner preventing narrowing of the opening after the expanding step.

16. The method of claim 11, further comprising the step of the liner outwardly supporting the expanded casing section after the expanding step.

17. The method of claim 11, further comprising the step of the liner maintaining the compressive stress in the formation after the expanding step.

18. The method of claim 11, further comprising the step of gravel packing an annulus formed between the liner and a well screen.

19. The method of claim 11, wherein the casing section is a portion of a pre-existing casing string, whereby the casing section is free of any expansion control device prior to installation of the liner.

20. The method of claim 11, further comprising the step of injecting a flexible cement external to the casing section prior to the expanding step.

* * * * *